US010837309B2

(12) United States Patent
Pratt et al.

(10) Patent No.: US 10,837,309 B2
(45) Date of Patent: Nov. 17, 2020

(54) RETENTION CLIP FOR VARIABLE VANE ARM

(71) Applicant: United Technologies Corporation, Farmington, CT (US)

(72) Inventors: William S. Pratt, West Hartford, CT (US); Matthew E. Bintz, West Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 35 days.

(21) Appl. No.: 16/379,179

(22) Filed: Apr. 9, 2019

(65) Prior Publication Data

US 2020/0325792 A1 Oct. 15, 2020

(51) Int. Cl.
*F01D 17/16* (2006.01)
*F01D 9/04* (2006.01)

(52) U.S. Cl.
CPC ..... *F01D 17/162* (2013.01); *F01D 9/042* (2013.01); *F05D 2260/50* (2013.01); *F05D 2260/79* (2013.01)

(58) Field of Classification Search
CPC ..... F01D 17/162; F01D 9/042
See application file for complete search history.

(56) References Cited

U.S. PATENT DOCUMENTS 4,668,165 A * 5/1987 Ludwick ..... F01D 17/162 415/148
7,011,494 B2 3/2006 Kies et al.
10,208,618 B2 2/2019 Gasmen et al.
2003/0147743 A1 8/2003 Chatel et al.
2016/0201499 A1* 7/2016 Pudvah ..... F16B 21/16 415/148
2018/0163560 A1 6/2018 Mairhanser

FOREIGN PATENT DOCUMENTS

WO 2015026420 A1 2/2015

OTHER PUBLICATIONS

European Search Report for Application No. EP 20 15 5547; dated Jul. 8, 2020.

* cited by examiner

*Primary Examiner* — Courtney D Heinle
*Assistant Examiner* — Michael K. Reitz
(74) *Attorney, Agent, or Firm* — Cantor Colburn LLP

(57) ABSTRACT

A vane arm assembly for a gas turbine engine includes a vane stem having a circumferential groove axially spaced from an outer end of the vane stem. The assembly also includes a vane arm defining an arm aperture that the vane stem is disposed within. The assembly further includes a mechanical fastener retaining an axial position of the vane arm in the axial direction. The assembly yet further includes a retention clip having a base portion and at least one clip arm, the base portion defining a clip aperture that the vane stem is disposed within, the base portion disposed within the circumferential groove of the vane stem to couple the retention clip to the vane stem, the at least one clip arm including a retention member engaged with the vane arm to provide redundant axial retention of the vane arm.

20 Claims, 5 Drawing Sheets

RETENTION CLIP FOR VARIABLE VANE ARM

STATEMENT OF FEDERAL SUPPORT

This invention was made with Government support awarded by the United States. The Government has certain rights in the invention.

BACKGROUND

Exemplary embodiments pertain to the art of gas turbine engines and, more particularly, to a retention clip for a variable vane arm for use in gas turbine engines.

Some turbine engine includes a plurality of engine sections such as, for example, a fan section, a compressor section, a combustor section and a turbine section. The turbine engine may also include a variable area vane arrangement. Such a vane arrangement may be configured to guide and/or adjust the flow of gas into one of the engine sections. Alternatively, the vane arrangement may be configured to guide and/or adjust the flow of gas between adjacent stages of a respective one of the engine sections.

Some variable vane arrangements include a plurality of adjustable stator vanes that are rotatably connected to an inner vane platform and an outer vane platform. Each of the stator vanes includes an airfoil that extends between the inner and the outer vane platforms. Each of the stator vanes may be rotated about a respective axis using a vane arm. A vane arm may be a sheet metal or machined piece that transmits load from a synchronizing ring to a variable vane stem.

The variable stator vanes may be leveraged to dynamically trade low power stability for high power efficiency during operation. Each stator vane in the compressor is opened and closed with the synchronizing ring via the vane arm. A fastener at an axial end of the vane stem secures the vane arm to the vane stem. If the fastener were to come loose during operation, the variable stator vane may close and create unexpected excitation and other undesirable results.

BRIEF DESCRIPTION

Disclosed is a vane arm assembly for a gas turbine engine. The vane arm assembly includes a vane stem having a circumferential groove axially spaced from an outer end of the vane stem, an axial direction being the longitudinal direction of the vane stem. The vane arm assembly also includes a vane arm defining an arm aperture that the vane stem is disposed within. The vane arm assembly further includes a mechanical fastener retaining an axial position of the vane arm in the axial direction. The vane arm assembly yet further includes a retention clip having a base portion and at least one clip arm, the base portion defining a clip aperture that the vane stem is disposed within, the base portion disposed within the circumferential groove of the vane stem to couple the retention clip to the vane stem, the at least one clip arm including a retention member engaged with the vane arm to provide redundant axial retention of the vane arm.

In addition to one or more of the features described above, or as an alternative, further embodiments may include that the clip aperture is defined by a plurality of wall segments comprising a pair of linear wall segments on opposing sides of the clip aperture and a pair of curved wall segments on opposing sides of the clip aperture.

In addition to one or more of the features described above, or as an alternative, further embodiments may include that the vane stem includes a pair of angled faces on opposing sides of the vane stem, the curved wall segments circumferentially aligned with the angled faces in an unlocked position of the retention clip, the linear wall segments circumferentially aligned with the angled faces in a locked condition of the retention clip, the base portion of the retention clip being rotatable within the circumferential groove of the vane stem.

In addition to one or more of the features described above, or as an alternative, further embodiments may include that the vane arm includes a ledge defining a notch, the retention member of the at least one clip arm disposed within the notch to axially retain the vane arm.

In addition to one or more of the features described above, or as an alternative, further embodiments may include that the at least one clip arm of the retention clip comprises a pair of clip arms, each of the clip arms having a retention member.

In addition to one or more of the features described above, or as an alternative, further embodiments may include that the vane arm includes a pair of ledges on opposing sides of the vane arm, the ledges defining a pair of notches, the retention member of each of the pair of clip arms disposed within one of the respective notches to axially retain the vane arm.

In addition to one or more of the features described above, or as an alternative, further embodiments may include that each of the pair of clip arms is formed of a resilient material.

In addition to one or more of the features described above, or as an alternative, further embodiments may include that the entire retention clip is formed of a resilient material.

In addition to one or more of the features described above, or as an alternative, further embodiments may include that the mechanical fastener is a lock nut.

Also disclosed is a method of redundantly axially retaining a vane arm of a variable vane assembly. The method includes positioning a retention clip over an outer end of a vane stem, the vane stem aligned with a clip aperture of the retention clip. The method also includes axially translating the retention clip to dispose the vane stem within the clip aperture, the retention clip oriented in a first position during axial translation until the base portion axially aligned with a circumferential groove of the vane stem. The method further includes rotating the retention clip within the circumferential groove to a second position to axially lock the retention clip. The method yet further includes mounting a vane arm to the vane stem, the retention clip engaging the vane arm to axially retain the vane arm.

In addition to one or more of the features described above, or as an alternative, further embodiments may include that the clip aperture includes a plurality of wall segments comprising a pair of linear wall segments on opposing sides of the clip aperture and a pair of curved wall segments on opposing sides of the clip aperture, the vane stem having a pair of angled faces on opposing sides of the vane stem, wherein the first position of the retention clip is defined by circumferential alignment of the curved wall segments with the angled faces of the vane stem, the second position of the retention clip defined by circumferential alignment of the linear wall segments with the angled faces of the vane stem.

In addition to one or more of the features described above, or as an alternative, further embodiments may include that rotation of the retention clip from the first position to the second position includes rotation of 90 degrees.

In addition to one or more of the features described above, or as an alternative, further embodiments may include that engagement of the retention clip to the vane arm includes biasing a pair of resilient clip arms outwardly during axial translation of the vane arm until retention members of the clip arms are positioned within a pair of notches of the vane arm.

In addition to one or more of the features described above, or as an alternative, further embodiments may include securing a lock nut to an outer end of the vane stem to redundantly axially retain the vane arm.

Further disclosed is a gas turbine engine that includes a compressor section, a combustor section, a turbine section, and a vane arm assembly for a gas turbine engine. The vane arm assembly includes a vane stem having a circumferential groove axially spaced from an outer end of the vane stem, an axial direction being the longitudinal direction of the vane stem. The vane arm assembly also includes a vane arm defining an arm aperture that the vane stem is disposed within. The vane arm assembly further includes a mechanical fastener retaining an axial position of the vane arm in the axial direction. The vane arm assembly yet further includes a retention clip having a base portion and a pair of clip arms, the base portion defining a clip aperture that the vane stem is disposed within, the base portion disposed within the circumferential groove of the vane stem to couple the retention clip to the vane stem, each of the clip arms including a retention member engaged with a pair of ledges on opposing sides of the vane arm, the ledges defining a pair of notches, the retention member of each of the pair of clip arms disposed within one of the respective notches to provide redundant axial retention of the vane arm.

In addition to one or more of the features described above, or as an alternative, further embodiments may include that the clip aperture is defined by a plurality of wall segments comprising a pair of linear wall segments on opposing sides of the clip aperture and a pair of curved wall segments on opposing sides of the clip aperture.

In addition to one or more of the features described above, or as an alternative, further embodiments may include that the vane stem includes a pair of angled faces on opposing sides of the vane stem, the curved wall segments circumferentially aligned with the angled faces in an unlocked position of the retention clip, the linear wall segments circumferentially aligned with the angled faces in a locked condition of the retention clip, the base portion of the retention clip being rotatable within the circumferential groove of the vane stem.

In addition to one or more of the features described above, or as an alternative, further embodiments may include that each of the pair of clip arms is formed of a resilient material.

In addition to one or more of the features described above, or as an alternative, further embodiments may include that the entire retention clip is formed of a resilient material.

In addition to one or more of the features described above, or as an alternative, further embodiments may include that the mechanical fastener is a lock nut.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
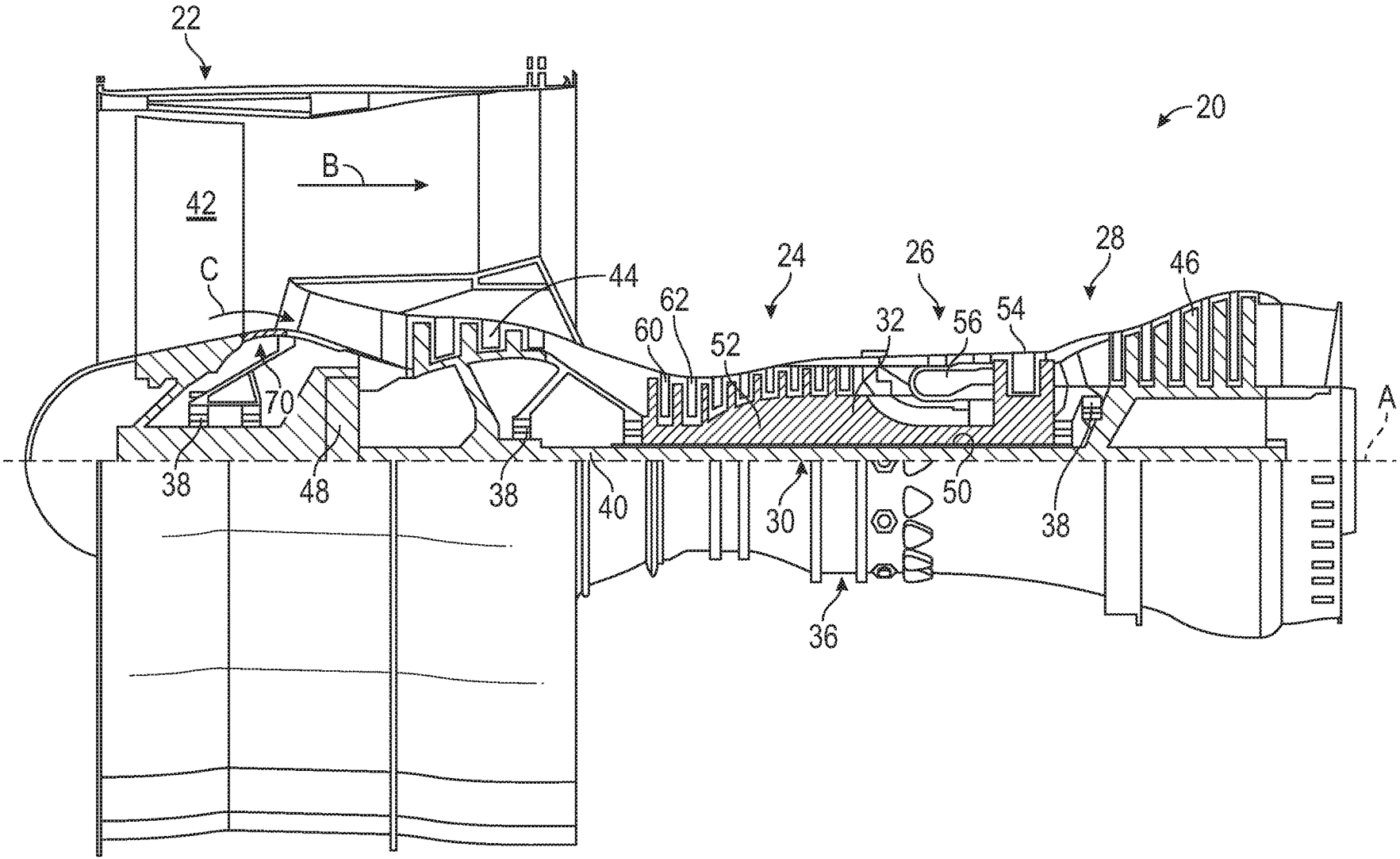
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, and turbine section 28 may be varied.

With continued reference to FIG. 1, the engine 20 also includes one or more variable area vane arrangements; e.g., vane arrangements 60, 62, etc. The vane arrangements directs gas for a respective engine section. In the illustrated example, the vane arrangement 60 guides and/or adjusts the flow of the core air into the compressor section 24. The vane arrangement 62 guides and/or adjusts the flow of the core air through the HPC section 24; e.g., between adjacent HPC rotor stages.

Figure 2:
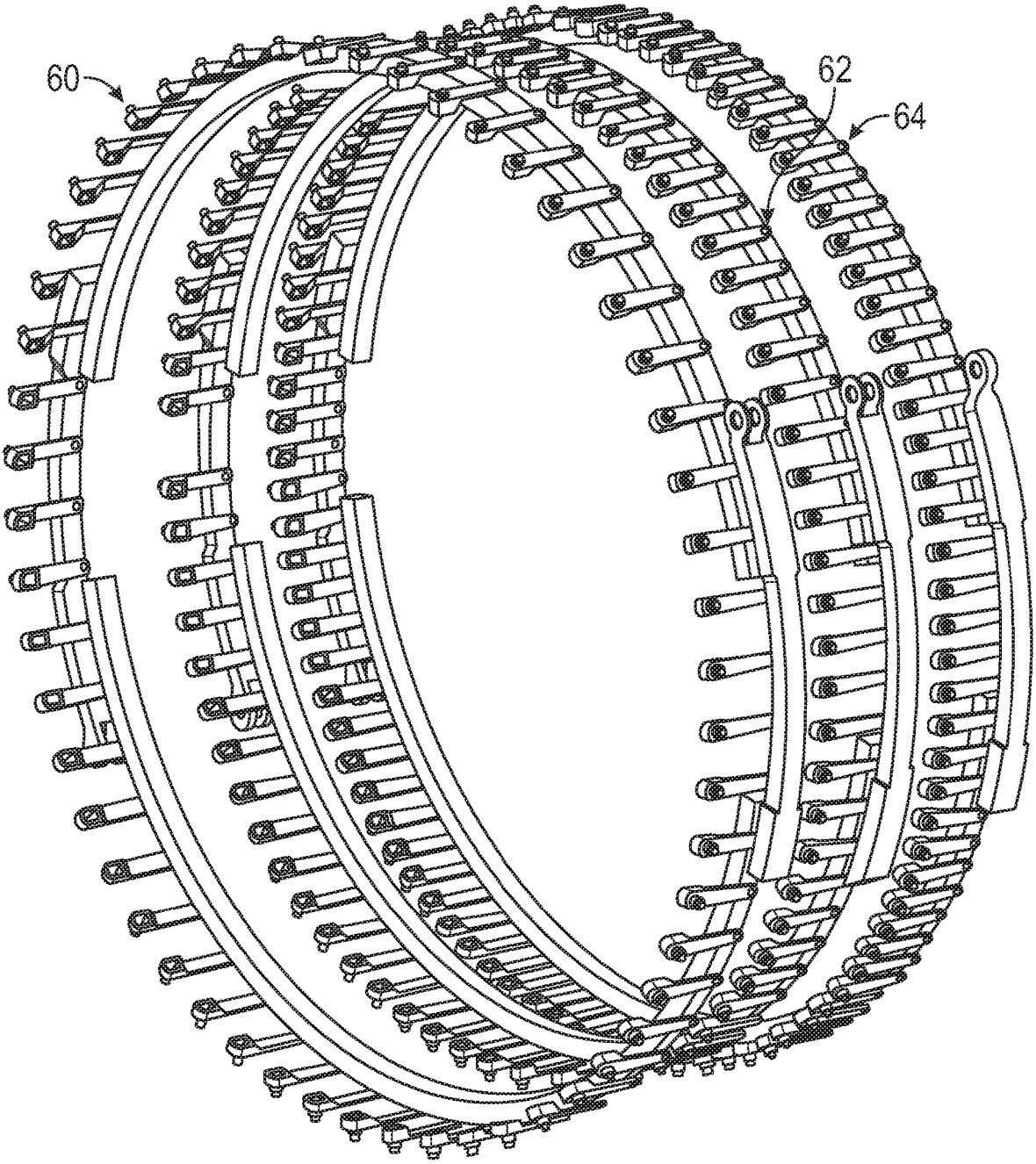
FIG. 2 is a perspective view of a variable vane arrangements of the gas turbine engine.

Referring now to FIG. 2, three vane arrangements 60, 62, 64 are illustrated. The number of arrangements may vary depending upon the particular application. Regardless of the number of vane arrangements, each arrangement includes one or more adjustable stator vanes that are arranged circumferentially around the central axis. Each of the stator vanes may be rotated about its respective axis by pivoting a respective vane arm assembly 100 with an actuator (not shown).

Figure 3:
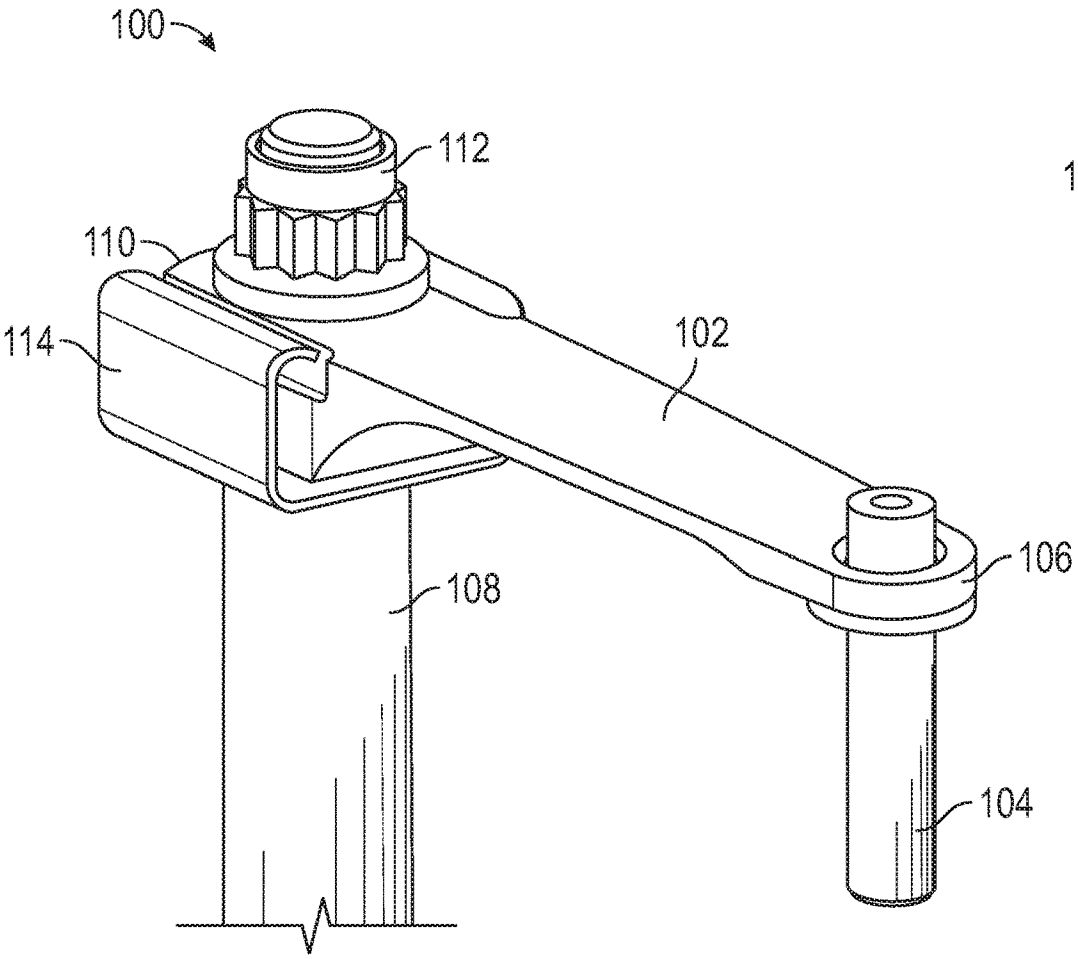
FIG. 3 is a perspective view of a variable vane arm assembly in a fully assembled condition.

Referring to FIG. 3, the vane arm assembly 100 is illustrated in greater detail and in an assembled condition. The vane arm assembly includes a vane arm 102. The vane arm 102 is operatively coupled to the actuator with a pin 104 proximate a first end 106 of the vane arm 102. The vane arm 102 is coupled to a vane stem 108 proximate a second end 110 of the vane arm 102. Coupling of the vane arm 102 to the vane stem 108 is made with corresponding geometry of the vane stem 108 and interior portions of the vane arm 102, as well as a lock nut 112 and a retention clip 114, as described in detail herein. As will be appreciated from the description herein, the redundant forms of retention provided by the lock nut 112 and the retention clip 114 ensure multiple layers of retention and can withstand significant surge loading that may occur. Additionally, the vane arm assembly 100 disclosed herein allows for a more reliable and efficient assembly process.

Figure 4:
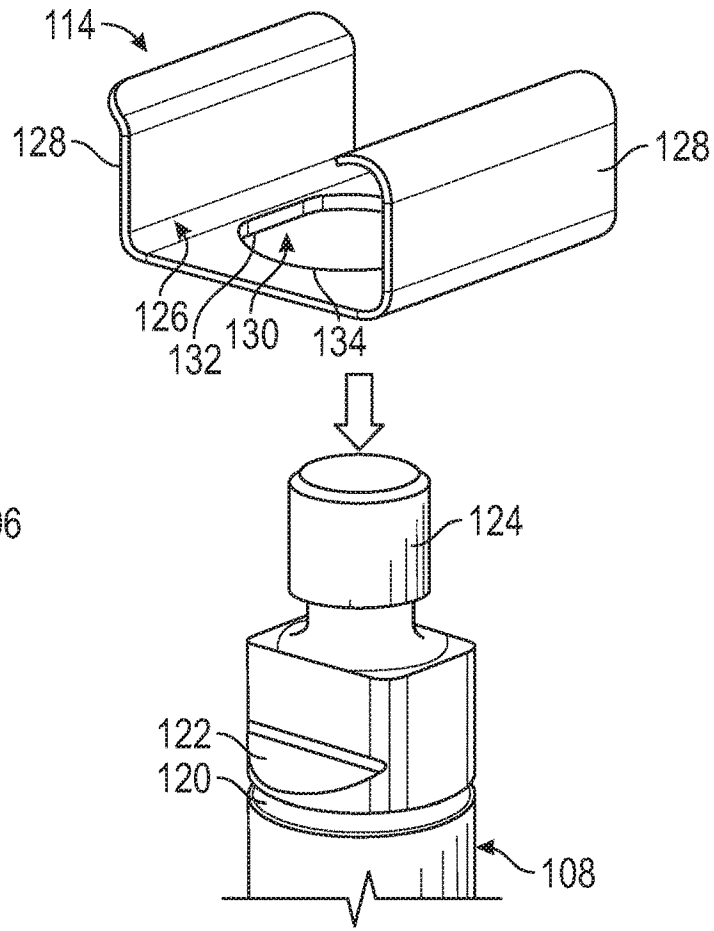
FIG. 4 is a perspective view of a retention clip and a vane stem in a first assembly condition.

Referring now to FIGS. 4-10, multiple stages of an assembly process of the vane arm assembly 100 is illustrated. In FIG. 4, the retention clip 114 is shown prior to assembly with the vane stem 108. The vane stem 108 has a substantially circular cross sectional geometry along a portion of the vane stem 108, but includes various assembly features proximate the axially outer portion of the vane stem 108. In particular, the vane stem 108 includes a circumferentially extending groove 120 that extends around the vane stem 108. Axially outward of the groove 120 is a pair of angled faces 122 of the vane stem 108. The angled faces 122 are on opposing sides of the vane stem 108. Axially outward of the wedge faces 122 is an interface portion 124 that may be a threaded portion for engaging the lock nut 112 during subsequent assembly of the vane arm 102.

The terms "axial" and "circumferential", as used herein, are with respect to the vane stem 108. In particular, the axial direction corresponds to a longitudinal direction of the vane stem 108, and the circumferential direction refers to a substantially circular direction around the perimeter of the vane stem 108.

The retention clip 114 includes a base portion 126 and a pair of arms 128 extending away from the base portion 126 in a substantially perpendicular direction thereto. The pair of arms 128, and the entire clip 114 in some embodiments, are formed of a resilient material such as a spring metal, for example. The base portion 126 of the retention clip 114 defines a clip aperture 130 that is defined by a plurality of aperture wall segments. In the illustrated example, the wall segments include a pair of linear wall segments 132 on opposing sides of the clip aperture 130, as well as a pair of curved wall segments 134.

Figure 5:
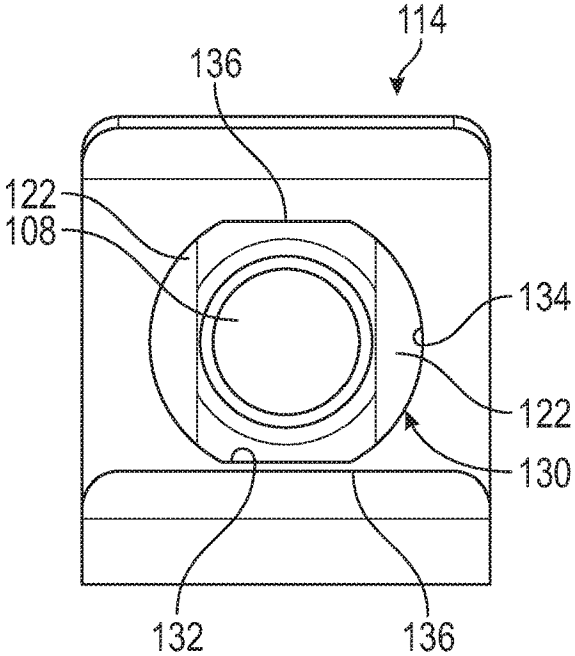
FIG. 5 is a perspective view of the retention clip and the vane stem in a second assembly condition.

As shown in FIGS. 4 and 5, the clip aperture 130 is sized to fit over, or receive, the axially outward portion of the vane stem 108. As described above, the vane stem 108 includes the angled faces 122 on opposing sides of the vane stem 108. The remaining circumferential portion of the vane stem 108 includes a pair of flat surfaces 136 that correspond to the linear wall segments 132 of the aperture wall. The curved wall segments 134 provide space to accommodate the protruding angled faces 122 of the vane stem 108. Therefore, assembly of the retention clip 114 in the orientation shown in FIGS. 4 and 5 allow the retention clip 114 to pass over the wedge faces 122, but the retention clip 114 would not assemble to the vane stem 108 if rotated away from the illustrated orientation.

Figure 7:
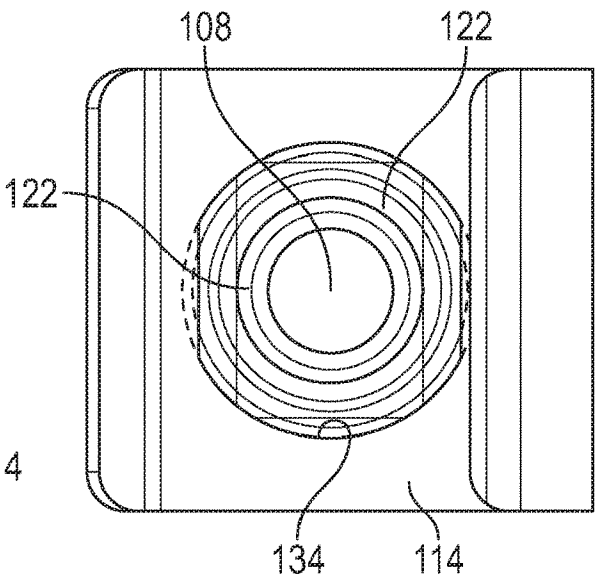
FIG. 7 is a perspective view of the retention clip and the vane stem in a fourth assembly condition.
Figure 6:
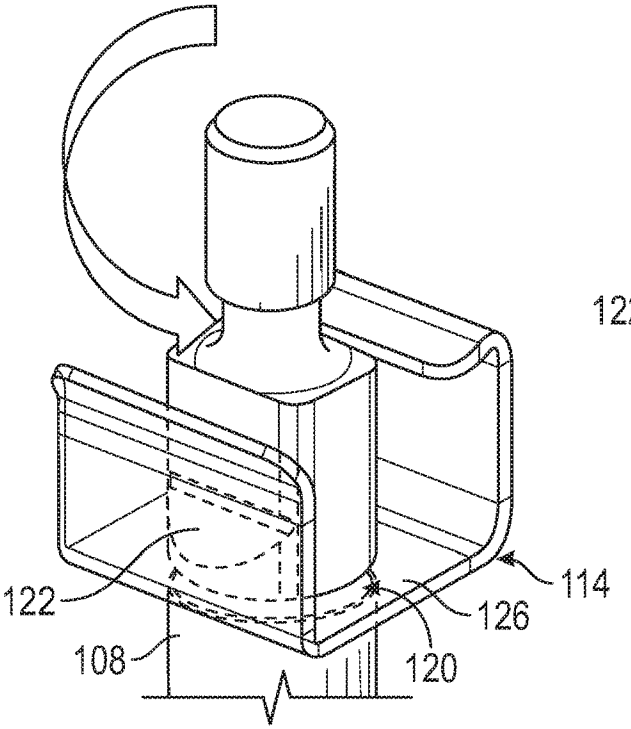
FIG. 6 is a perspective view of the retention clip and the vane stem in a third assembly condition.

Referring now to FIGS. 6 and 7, the retention clip 114 is translated axially in the orientation of FIGS. 4 and 5 until the clip aperture 130 (i.e., plane of base portion 126) is axially aligned with the groove 120 of the vane stem 108. Upon axially reaching the groove 120, the retention clip 114 is rotated into a locked condition of the retention clip 114. In the illustrated embodiment, the retention clip 114 is rotated about 90 degrees to reach the locked condition. Upon rotation to the locked condition of FIGS. 6 and 7, the linear wall segments 132 of the retention clip 114 are positioned under the wedge faces 122 and within the groove 120, which prevents axial withdrawal of the retention clip 114. Therefore, the retention clip 114 is axially locked.

Figure 9:
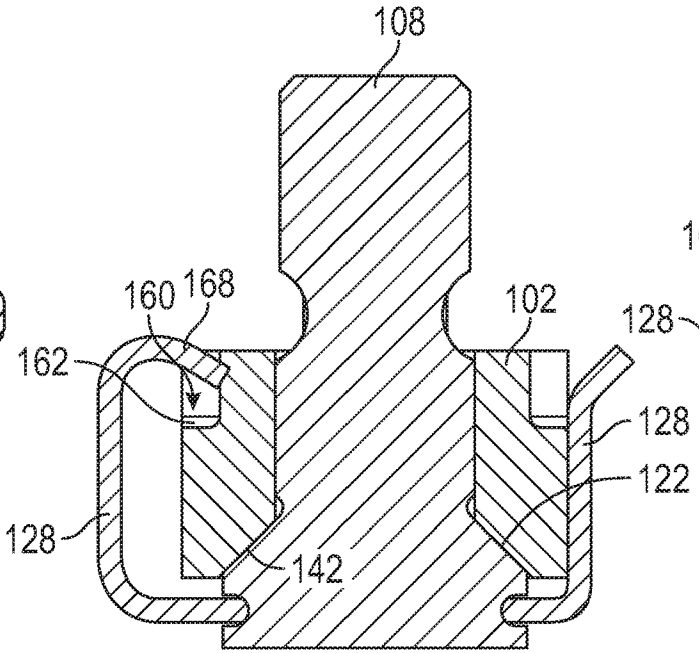
FIG. 9 is a perspective view of the vane arm in a second assembly condition.
Figure 8:
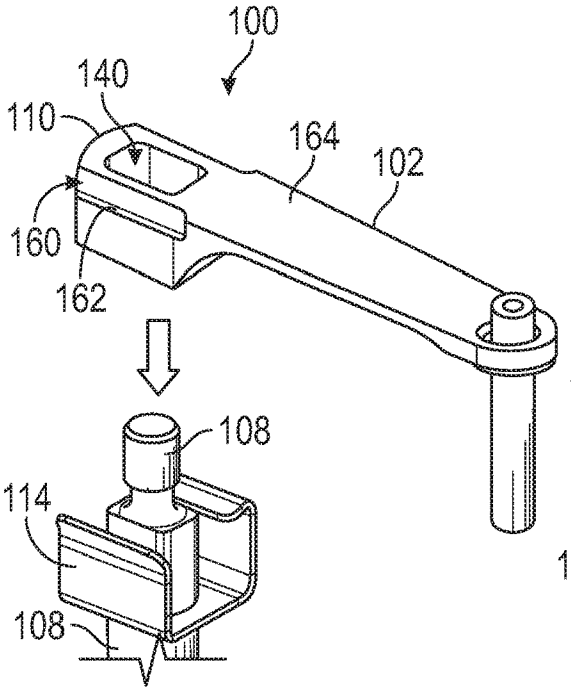
FIG. 8 is a perspective view of a vane arm in a first assembly condition.

Referring now to FIGS. 8 and 9, the vane arm 102 defines an arm aperture 140 proximate the second end 110 that receives the vane stem 108 therethrough. At an axially inner portion of the wall that defines the aperture 140 is an angled face, which may also be referred to as a wedge face 142. The wedge face 142 extends around at least a portion of the aperture wall and is shown well in FIG. 9. In the illustrated embodiment, a pair of wedge faces 142 are disposed on opposing sides of the aperture 140. The geometry of the wedge faces 142 substantially corresponds to the angled faces 122 of the vane stem 108. The surfaces of the faces 142, 122 are in contact in a preloaded condition upon assembly, with the substantially corresponding geometry transmitting torque from the vane arm 102 to the vane stem 108 under normal operation of the vane arm assembly 100 and the compressor section 24.

Figure 10:
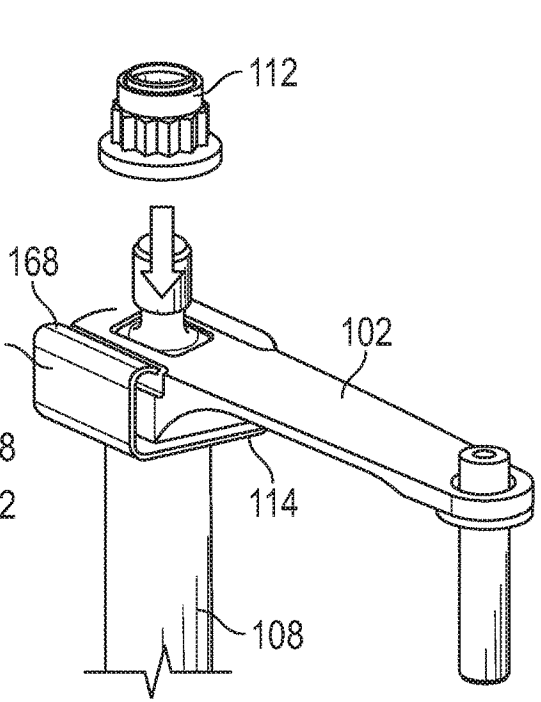
FIG. 10 is a perspective view of the vane arm in a third assembly condition.

The vane arm 102 is assembled onto the vane stem 108 by passing the vane stem 108 through the arm aperture 140 to achieve contact between the wedge faces 142 with the angled faces 122. During assembly of the vane arm 102 to the vane stem 108, the resilient clip arms 128 of the retention clip 114 are biased outwardly by the vane arm 102 to allow the vane arm 102 to continue to translate into the assembled position. The vane arm 102 includes a notch 160 on each side thereof, with each notch 160 defined by a ledge 162 spaced from the axially outboard side 164 of the vane arm 102. Once the ledges 162 of the vane arm 102 pass through retention members 168 of the clip arms 128, the retention members 168 are positioned over the ledges 162 and into the notches 160 to axially retain the vane arm 102. Finally, as shown in FIG. 10, the lock nut 112 is assembled to the vane stem 108.

The interface between the vane arm 102 and the vane stem 108 prevents the assembly from freely rotating, and with the retention clip 114 preventing axial motion, both rotation and axial motion are locked and the vane arm 102 is retained.

The lock nut 112 and the retention clip 114 provides axial retention redundancy by avoiding movement of the vane arm 102 relative to the longitudinal direction of the vane stem 108 in the event the lock nut 112 is damaged or disengaged.

The embodiments described herein avoid the need to remove all vane arms simultaneously when only a single vane arm requires removal for maintenance or replacement. The disclosed embodiments allow a single vane arm to be installed and/or removed.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vane arm assembly for a gas turbine engine comprising:

a vane stem having a circumferential groove axially spaced from an outer end of the vane stem, an axial direction being a longitudinal direction of the vane stem;

a vane arm defining an arm aperture that the vane stem is disposed within;

a mechanical fastener retaining an axial position of the vane arm in the axial direction; and a retention clip having a base portion and at least one clip arm, the base portion defining a clip aperture that the vane stem is disposed within, the base portion disposed within the circumferential groove of the vane stem to couple the retention clip to the vane stem, the at least one clip arm including a retention member engaged with the vane arm to provide redundant axial retention of the vane arm.

2. The vane arm assembly of claim 1, wherein the clip aperture is defined by a plurality of wall segments comprising a pair of linear wall segments on opposing sides of the clip aperture and a pair of curved wall segments on opposing sides of the clip aperture.

3. The vane arm assembly of claim 2, wherein the vane stem includes a pair of angled faces on opposing sides of the vane stem, the curved wall segments circumferentially aligned with the angled faces in an unlocked position of the retention clip, the linear wall segments circumferentially aligned with the angled faces in a locked condition of the retention clip, the base portion of the retention clip being rotatable within the circumferential groove of the vane stem.

4. The vane arm assembly of claim 1, wherein the vane arm includes a ledge defining a notch, the retention member of the at least one clip arm disposed within the notch to axially retain the vane arm.

5. The vane arm assembly of claim 1, wherein the at least one clip arm of the retention clip comprises a pair of clip arms, each of the clip arms having a retention member.

6. The vane arm assembly of claim 5, wherein the vane arm includes a pair of ledges on opposing sides of the vane arm, the ledges defining a pair of notches, the retention member of each of the pair of clip arms disposed within one of the respective notches to axially retain the vane arm.

7. The vane arm assembly of claim 5, wherein each of the pair of clip arms is formed of a resilient material.

8. The vane arm assembly of claim 7, wherein the entire retention clip is formed of a resilient material.

9. The vane arm assembly of claim 1, wherein the mechanical fastener is a lock nut.

10. A method of redundantly axially retaining a vane arm of a variable vane assembly comprising:

positioning a retention clip over an outer end of a vane stem, the vane stem aligned with a clip aperture of the retention clip;

axially translating the retention clip to dispose the vane stem within the clip aperture, the retention clip oriented in a first position during axial translation until the base portion axially aligned with a circumferential groove of the vane stem;

rotating the retention clip within the circumferential groove to a second position to axially lock the retention clip; and mounting a vane arm to the vane stem, the retention clip engaging the vane arm to axially retain the vane arm.

11. The method of claim 10, wherein the clip aperture includes a plurality of wall segments comprising a pair of linear wall segments on opposing sides of the clip aperture and a pair of curved wall segments on opposing sides of the clip aperture, the vane stem having a pair of angled faces on opposing sides of the vane stem, wherein the first position of the retention clip is defined by circumferential alignment of the curved wall segments with the angled faces of the vane stem, the second position of the retention clip defined by circumferential alignment of the linear wall segments with the angled faces of the vane stem.

12. The method of claim 11, wherein rotation of the retention clip from the first position to the second position includes rotation of 90 degrees.

13. The method of claim 10, wherein engagement of the retention clip to the vane arm includes biasing a pair of resilient clip arms outwardly during axial translation of the vane arm until retention members of the clip arms are positioned within a pair of notches of the vane arm.

14. The method of claim 10, further comprising securing a lock nut to an outer end of the vane stem to redundantly axially retain the vane arm.

15. A gas turbine engine comprising:

a compressor section;

a combustor section;

a turbine section; and a vane arm assembly for a gas turbine engine comprising:

a vane stem having a circumferential groove axially spaced from an outer end of the vane stem, an axial direction being the longitudinal direction of the vane stem;

a vane arm defining an arm aperture that the vane stem is disposed within;

a mechanical fastener retaining an axial position of the vane arm in the axial direction; and a retention clip having a base portion and a pair of clip arms, the base portion defining a clip aperture that the vane stem is disposed within, the base portion disposed within the circumferential groove of the vane stem to couple the retention clip to the vane stem, each of the clip arms including a retention member engaged with a pair of ledges on opposing sides of the vane arm, the ledges defining a pair of notches, the retention member of each of the pair of clip arms disposed within one of the respective notches to provide redundant axial retention of the vane arm.

16. The gas turbine engine of claim 15, wherein the clip aperture is defined by a plurality of wall segments comprising a pair of linear wall segments on opposing sides of the clip aperture and a pair of curved wall segments on opposing sides of the clip aperture.

17. The gas turbine engine of claim 16, wherein the vane stem includes a pair of angled faces on opposing sides of the vane stem, the curved wall segments circumferentially aligned with the angled faces in an unlocked position of the retention clip, the linear wall segments circumferentially aligned with the angled faces in a locked condition of the retention clip, the base portion of the retention clip being rotatable within the circumferential groove of the vane stem.

18. The gas turbine engine of claim 15, wherein each of the pair of clip arms is formed of a resilient material.

19. The gas turbine engine of claim 18, wherein the entire retention clip is formed of a resilient material.

20. The gas turbine engine of claim 15, wherein the mechanical fastener is a lock nut.

* * * * *